US009743463B2

(12) United States Patent
Laghi et al.

(10) Patent No.: US 9,743,463 B2
(45) Date of Patent: Aug. 22, 2017

(54) INDUCTION HEATING DEVICE FOR SHAVING AND COSMETIC APPLICATIONS

(71) Applicant: Alps South Europe S.R.O., Bozkov (CZ)

(72) Inventors: Aldo A. Laghi, Clearwater, FL (US); Eric Prast, St. Petersburg, FL (US); Nate Vint, St. Petersburg, FL (US)

(73) Assignee: Alps South Europe S.R.O., Bozkov (CZ)

( * ) Notice: Subject to any disclaimer, the term of this patent is extended or adjusted under 35 U.S.C. 154(b) by 0 days.

(21) Appl. No.: 15/131,126

(22) Filed: Apr. 18, 2016

(65) Prior Publication Data

US 2016/0234886 A1 Aug. 11, 2016

Related U.S. Application Data

(63) Continuation-in-part of application No. 14/341,696, filed on Jul. 25, 2014, now Pat. No. 9,469,521.

(51) Int. Cl.

| | |
|---|---|
| ***H05B 6/00*** | (2006.01) |
| ***H05B 6/10*** | (2006.01) |
| ***H05B 6/06*** | (2006.01) |
| *A45D 27/00* | (2006.01) |

(52) U.S. Cl.

CPC ..... *H05B 6/06* (2013.01); *H05B 6/105* (2013.01); *A45D 27/00* (2013.01); *A45D 2200/155* (2013.01)

(58) Field of Classification Search

CPC . H05B 6/02; H05B 6/06; H05B 6/802; H05B 6/40; H05B 6/42; H05B 6/108; H05B 6/62; H05B 6/062; H05B 6/105; H05B 6/106; B67D 7/82; A45D 27/00; A45D 2200/155; A45D 44/00; A45D 44/0081

USPC ..... 219/214, 618, 625, 628, 634, 635, 674; 222/146.2, 146.5

See application file for complete search history.

(56) References Cited

U.S. PATENT DOCUMENTS

| | | | | |
|---|---|---|---|---|
| 2,867,347 | A * | 1/1959 | Champagnat | B65D 88/34 220/216 |
| 2005/0011883 | A1* | 1/2005 | Clothier | F28D 20/0056 219/618 |
| 2011/0200381 | A1* | 8/2011 | Bylsma | A45D 34/04 401/118 |
| 2015/0157756 | A1* | 6/2015 | Duffield | A01M 1/2061 219/628 |
| 2015/0223292 | A1* | 8/2015 | Duffield | H05B 6/06 219/634 |

* cited by examiner

*Primary Examiner* — Hung D Nguyen
(74) *Attorney, Agent, or Firm* — GrayRobinson, P.A.

(57) ABSTRACT

An induction-heating device for heating and or melting a heat affected product zone of shaving or cosmetic products (6A) stored in a product container (6) which consists of a layer of the product immediately below a top product surface and heated by an electrically conductive metallic target member (7) having through-passages overlying the top product surface and energized by an induction coil (3) into which an electromagnetic field is generated by electronic circuitry for a predetermined time period into the product container, thereby permitting the heated and or melted product to flow through the through-passages onto the top surface of the target member to be collected by a user for shaving or cosmetic purposes.

31 Claims, 18 Drawing Sheets

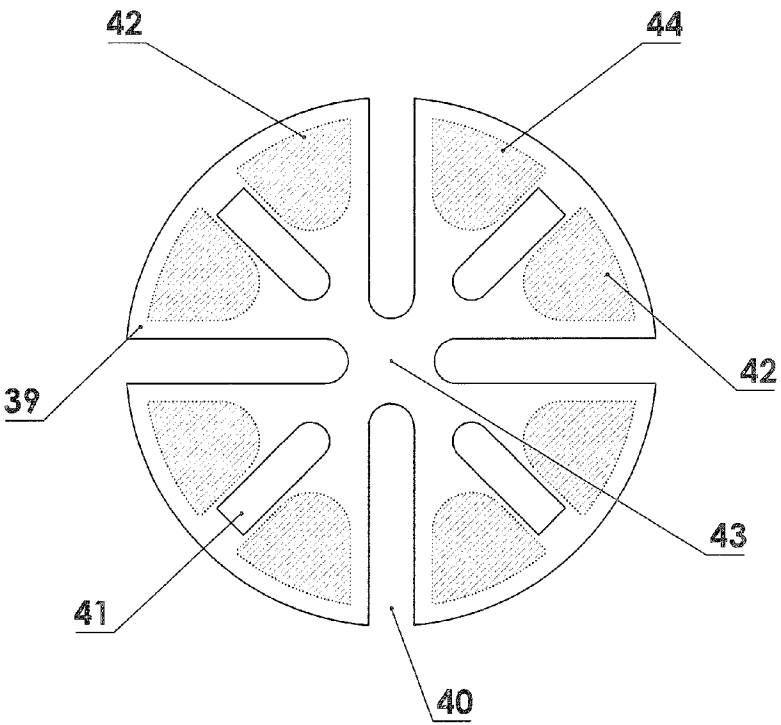
Fig 13
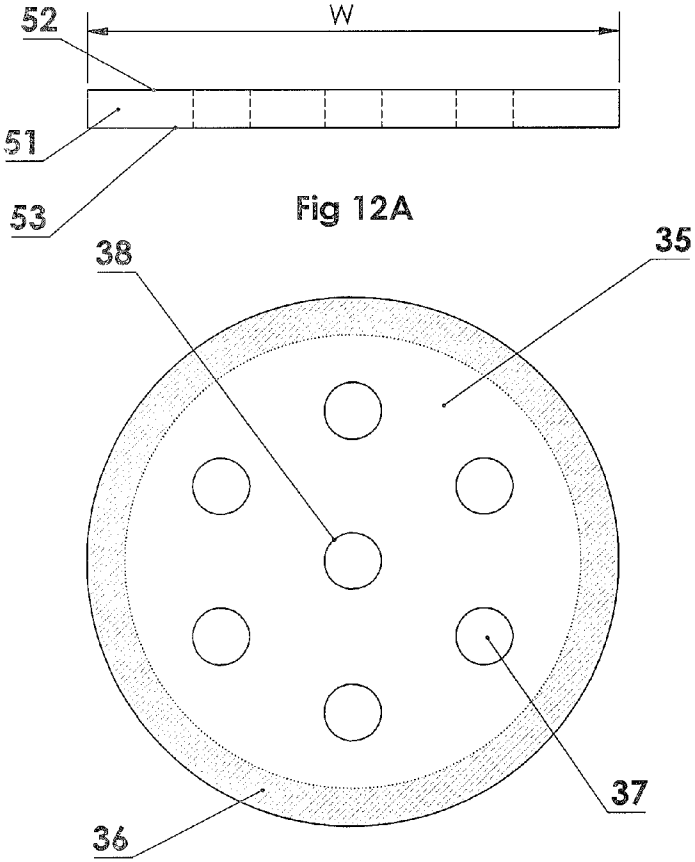
Fig 12A
Fig 12

INDUCTION HEATING DEVICE FOR SHAVING AND COSMETIC APPLICATIONS

CROSS-REFERENCE TO RELATED INVENTIONS

This application is a Continuation-in-Part of pending application Ser. No. 14/341,696 filed Jul. 25, 2014 and claims the benefit of PCT Application Number PCT/US15/50991, filed Sep. 18, 2015, the disclosures of which are hereby incorporated herein by reference.

TECHNICAL FIELD AND INDUSTRIAL APPLICABILITY OF THE INVENTION

This invention relates to the manufacture of a heater for warming shaving and cosmetic products. The heater includes an induction heating system mounted within a housing for heating a conductive target member disposed within a top surface region of a shaving or cosmetic product stored within a product container removably received in an induction receptacle. An induction-heating coil of the induction heating system is mounted adjacent the induction receptacle. When the heating system is activated, an electromagnetic field is generated within the product container for heating only the target member and thereby heating only a "heat affected product zone". The "heat affected product zone" is the upper surface region of the product immediately above and below the target member wherein the product becomes heated and or melted and staged for the user.

BACKGROUND OF THE INVENTION

Basic principles of induction heating date back to Michael Faraday's work in 1831. Induction heating is the process of heating an electrically conductive object by electromagnetic induction, where eddy currents are generated within the target workpiece. This technology is widely used in industrial welding, brazing, bending, and sealing processes. Also, induction heating has grown very popular in culinary applications, providing a more efficient and accelerated heating of liquids and/or foods on stovetops or in ovens. Advantages of using an induction heating system are an increase in efficiency by using less energy and also generating heat to a specific target member.

Applying heated shaving cream or cleansing gel to the skin opens pores translating in a more comfortable shave or a more effective skin cleansing. Currently the process of heating shaving cream to the desired temperature is difficult. It requires meticulous attention and practice. Overheating can ruin the product and under-heating does not generate the desired effect. The technology available to heat shaving cream often requires shaving cream to be in an aerosol dispensed can. An aerosol based shaving cream is often times of poor quality. These shaving cans are often destroyed by repeated process of heating, and also unevenly heat the product. Resistance heating of the can is also extremely inefficient and causes the shaving can to remain hot for long periods after use. In the previously mentioned heating methods, the portion of product or material not used in the container is also cyclically heated. This cyclic heating degrades the composition of the product or material.

One attempt of using an induction heating system is disclosed by Brown, et al. in US 20080257880 A1. Brown, et al. disclose an induction heating dispenser having a refill unit 8 heated by primary and secondary induction coils 2 and 13. As disclosed in paragraph [0020], the dispenser can be used for many different applications such as air fresheners, depilatory waxes, insecticides, stain removal products, cleaning materials, creams and oils for applications to the skin or hair, shaving products, shoe polish, furniture polish, etc. The refill unit 8 comprises a multiplicity of replaceable containers 9 for holding the respective products. The containers are sealed under a porous membrane 11. As disclosed in paragraph [0011], the porous membrane is usually removed for meltable solid substances. For volatile liquid substances, the porous membrane is not removed. As disclosed in paragraph [0023], the porous membrane 11 has a porosity that allows vapor to pass through but not liquid to prevent spillage. Also, in paragraph [0020], for heated products that are applied to a surface, the container may have an associated applicator such as a brush, pad or sponge.

Another heated dispenser system is disclosed by Bylsma, et al. in US 20110200381 A1. Bylsma, et al. disclose a dispenser wherein the heating unit could be either in the base unit 10 as illustrated in FIG. 4, or in the applicator 42 as illustrated in FIG. 5. As disclosed in paragraph [0026], the heating unit may be an inductive power coupling. As disclosed in paragraphs [0030-0036], the applicator may be of many different forms depending on the product to be dispensed.

Although the prior art systems have proven to be quite useful for their purposes, none have been designed to be energy efficient or to heat and/or melt only the amount of composition necessary for the immediate application as accomplished by the present invention.

Therefore, it is an object of this invention to provide an improvement which overcomes the aforementioned inadequacies of the prior art devices and provides an improvement which is a significant contribution to the advancement of the induction heating art.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention relates generally to a heater for warming products such as soaps, creams, lotions, gel compositions or other solutions (hereinafter "product") for shaving purposes or cosmetic purposes such as skin cleansing. The products are stored in a container wherein only the upper portion of the products is heated and/or melted by an induction-heating device. An electrically conductive metallic member (hereinafter "target member") having through-passages is positioned generally on the top surface of the product within the product container. As the target member becomes heated by the induction system, the heated and/or melted product flows through the through-passages. The present invention instantaneously heats only a portion or volume of product necessary for immediate application by the user.

The present invention is an induction-heating device having a housing with a top outer surface defining an induction receptacle. Mounted within said housing is an electromagnetic heating circuit and an induction coil. The induction coil is disposed in parallel relation to the induction receptacle as described hereinafter. A user interface is also mounted in the top surface of the housing for controlling the warming and/or melting or liquefying the product in the "heat affected product zone". The device includes an induction receptacle that accepts a product container filled with a product. The electromagnetic heating circuit and induction coil generate an electromagnetic field within the product container that induces eddy currents into the target member thereby heating the target member. The present invention may be further characterized in that the induction coil may have various configurations as described in further detail hereinafter for varying the electromagnetic field. Inside the product container, the target member is disposed across the top surface of the product. The target member comprises through-passages for allowing heated and/or melted product to flow therethrough. The heat generated in the target member is then conducted to the "heat affected product zone" of the product to heat and/or melt or liquefy only the product in the "heat affected product zone". The target member then acts as an interface between the user (or user's brush, pad, cloth, finger, and the like) and the product. The target member may be comprised of various geometric configurations that allow the user to stir or agitate different products to the desired temperature and/or consistency. In applications requiring the product to be heated (such as cosmetics, lotions, creams, balms, waxes, etc.), the target member would be predominantly flat. In applications requiring the product to be heated and lathered, the target member would be comprised of non-flat geometry including raised portions or indentions depending on orientation of the target member within the product receptacle. Alternative to a relatively flat profile, the target member may be dish-shaped, cup-shaped or corrugated-shaped. The target member may comprise an electrically conductive disc made of a metal screen, a metal plate perforated with holes, slots or a combination of holes and slots, all of which provide through-passages to allow product to pass therethrough. Although the preferred shape of the target member is disc-shaped, other geometric shapes may also be employed such as square-shaped or rectangular-shaped depending on the shape of the product container as discussed in more detail hereinafter. As the product in the heat affected product zone is only heated and/or melted, an applicator such as a shaving brush or skin pad can be used to collect the heated and/or melted product from the upper surface of the target member which can be applied to the face or any other desired location of the body. The present invention is a more effective means of heating the product; especially for an amount necessary for the immediate application since only the product in the heat affected product zone is heated and/or melted. As different products may be stored in different containers, the containers of product are easily accessible and interchangeable from the induction receptacle. A unique RFID tag is incorporated into each product cup to allow the product and associated target member to be uniquely identified by the induction system to provide the necessary heating according to the advantages of the present invention. The present invention has no open flame, operates silently, and stays cool after the cup is removed. Furthermore, the product will return to its original form (e.g., solid, cream or gel) more quickly than if the entire product was melted, minimizing degradation of the product.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIGS. 12 through 20 show various embodiments of target members.

Similar reference characters refer to similar parts throughout the several views of the drawings.

DETAILED DESCRIPTION OF THE PREFERRED EMBODIMENT

Figure 1:
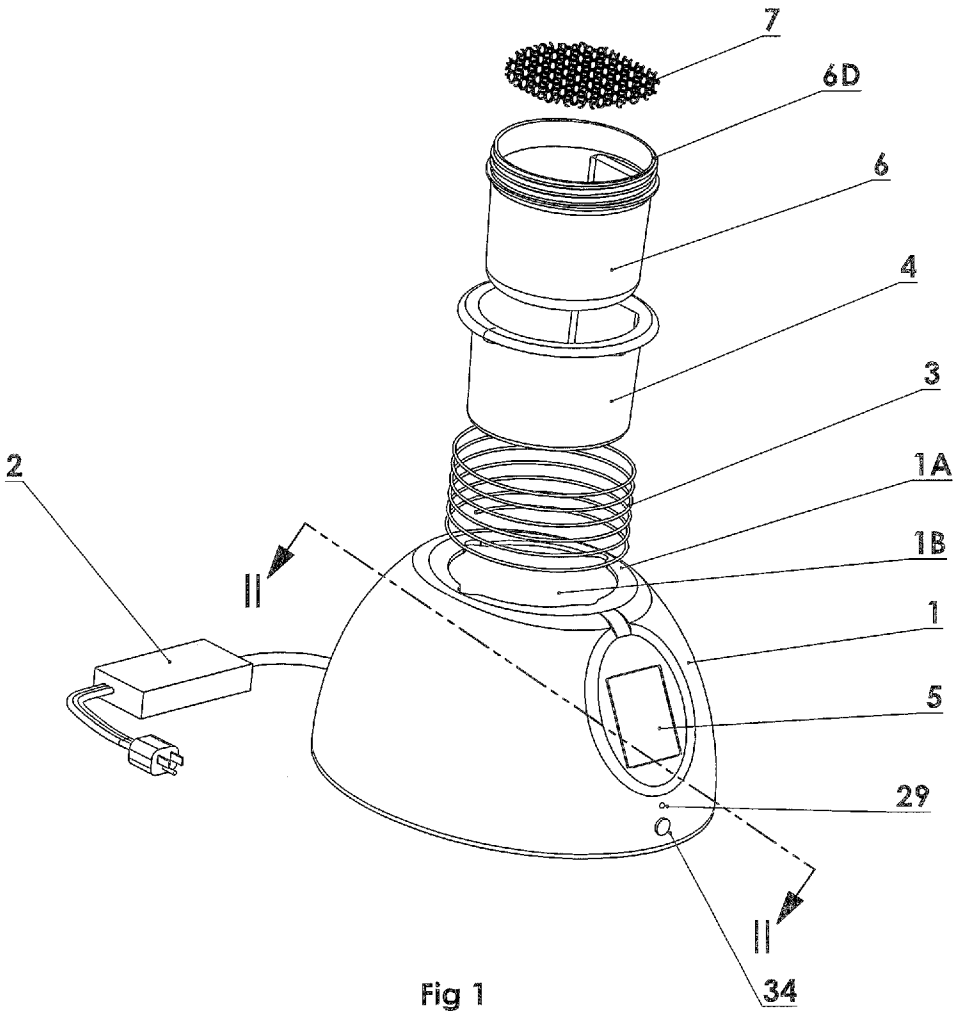
FIG. 1 is an exploded view of a first embodiment of the present invention trapezoidal-shaped housing.

As illustrated in FIG. 1, an exploded view of a first embodiment of the present invention basically includes an induction heating unit main housing (1) connected to a power supply (2). In describing the structure of the present invention, elements common to each embodiment will be given the same numerals. The main housing (1) has a top outer surface (1A) with an opening (1B). An induction receptacle (4) is mounted in the main housing (1) through opening (1B). An induction-heating coil (3) is mounted adjacent the induction receptacle (4). A product container (6) is removably inserted within the induction receptacle (4). In this first embodiment, the product container (6) includes flange (6D) for receiving a closure (not shown) such as a conventional foil adhered to the flange.

Figure 2:
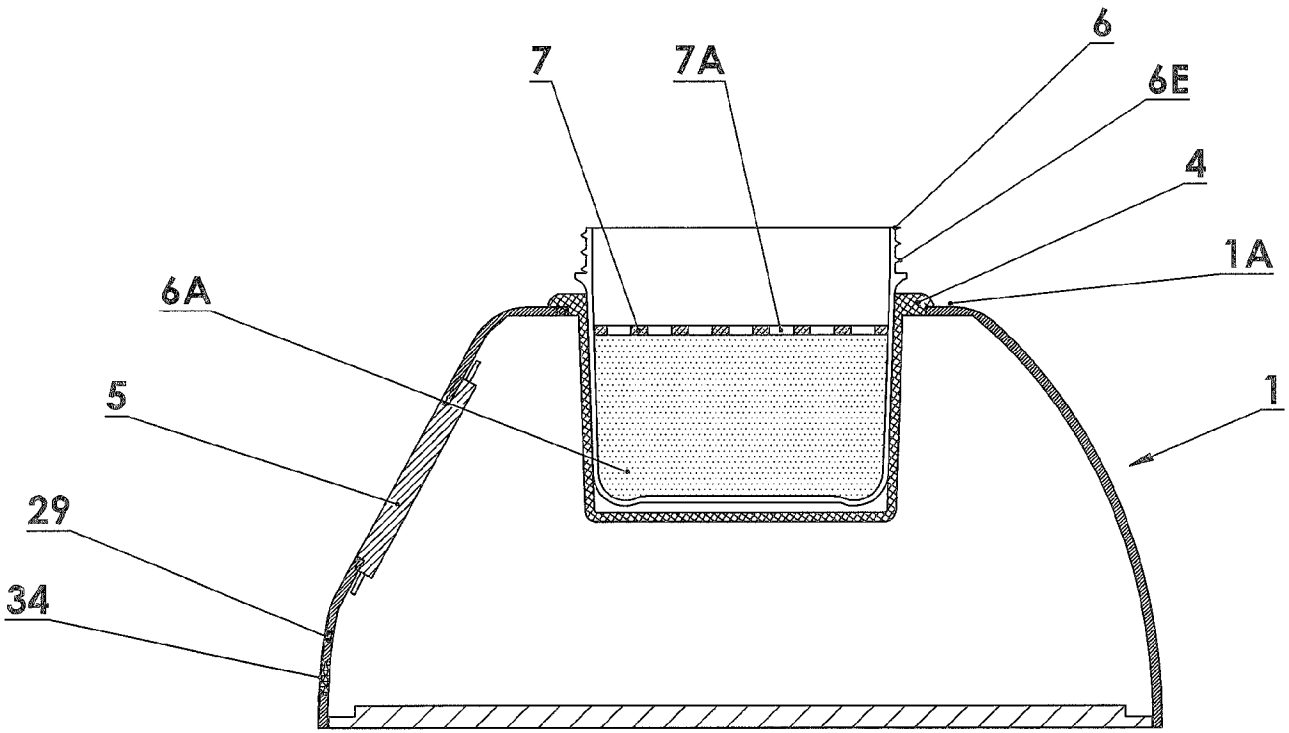
FIG. 2 is a cross-sectional view along the lines II-II shown in FIG. 1
Figure 3:
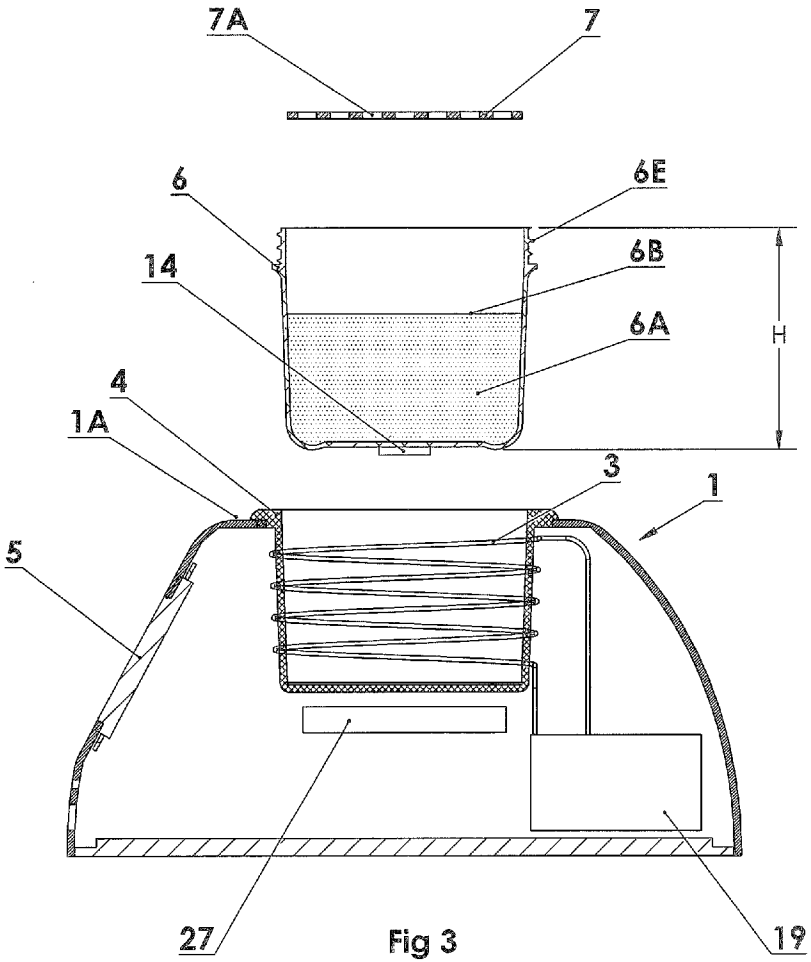
FIG. 3 is a cross-sectional view along the lines II-II shown in FIG. 1 inclusive of the induction heating system.

Referring to FIGS. 2 and 3, illustrated are cross-sections along lines II-II indicated in FIG. 1. The induction receptacle (4) has an open top extending through the top surface (1A). The induction-heating coil (3) surrounds the induction receptacle (4) and is controlled by microprocessor (19). The preferred diameter of the cup is between 2 and 4 inches (5.08 and 10.16 cm). Illustrated as (H) in FIG. 3, the height of the cup is between 0.5 to 2 times the diameter of the cup. Although the induction receptacle and product container are illustrated in the form of cylindrically shaped cups, the shape of the induction receptacle and product container is not intended to be so limited and other geometric configurations may be employed. Also, the product cup (6) shown in FIGS. 2 and 3 includes an upper threaded extension (6E) for receiving a threaded closure (not shown).

Referring to FIG. 3, an RFID tag (14) is mounted on or in the bottom surface of the product container (6) for transmitting data to the RFID reader (27) which translates information to the microprocessor (19) such as cycle time, resonant frequency of target member, product type, and other parameters needed to heat the product according to requirements. To ensure the key objectives of the present invention, i.e., immediate heating of the product for an application and to minimize the degradation of the product, the present invention requires the successful transmission of the information from the RFID tag (14) to the RFID reader (27). A conductive target member (7) having through-passages (7A) is removably inserted within product container (6) and initially rests on the upper surface (6B) of an unheated product (6A) contained within the container. By using the terminology "conductive target member" herein is meant that it is the only structural element of the present invention within the product container (6) that is heated by the induction-heating coil (3). The heat from the "conductive target member" is then transferred to the "heat affected product zone" as described hereinbefore. As explained and emphasized in further detail hereinafter, the cycle time is adjusted to heat and/or melt the product only in the "heat affected product zone" thereby allowing product to flow through the through-passages. Once the cycle time is completed and the product cools and returns to its initial state, the target member remains embedded within the upper surface region of the product. The materials used to manufacture the main housing (1), induction receptacle (4) and product container (6) are non-metallic and non-electrically conductive. Such materials are well known and may include any type of well known polymeric composition. With the selection of materials used to manufacture the present invention and the operation of the present invention as described hereinafter, the heated target member (7) heats and/or melts the product only in the "heat affected product zone". The product itself is not heated directly by the induction heater coil (3). Also shown is operator interface or user interface window (5) in a side surface of housing (1) that allows the user to interact with the device through visual and touch based actions. The target member (7) in the embodiment illustrated in FIG. 1 is an electrically conductive metallic screen. The interstices between the metallic strands of the screen constitute through-passages. It is noted that the target member (7) comprises a geometry to nest within the product container (6), which comprises a geometry to nest within the induction receptacle (4). In other words, the peripheral dimensions of the target member (7) and in all embodiments of the present invention described herein are slightly less than the interior dimensions of the product container whereby the target member is free to fall within the product container as the product diminishes with each use. Also, the outer peripheral dimensions of the product container are slightly less than the interior dimensions of the induction receptacle.

Figure 4:
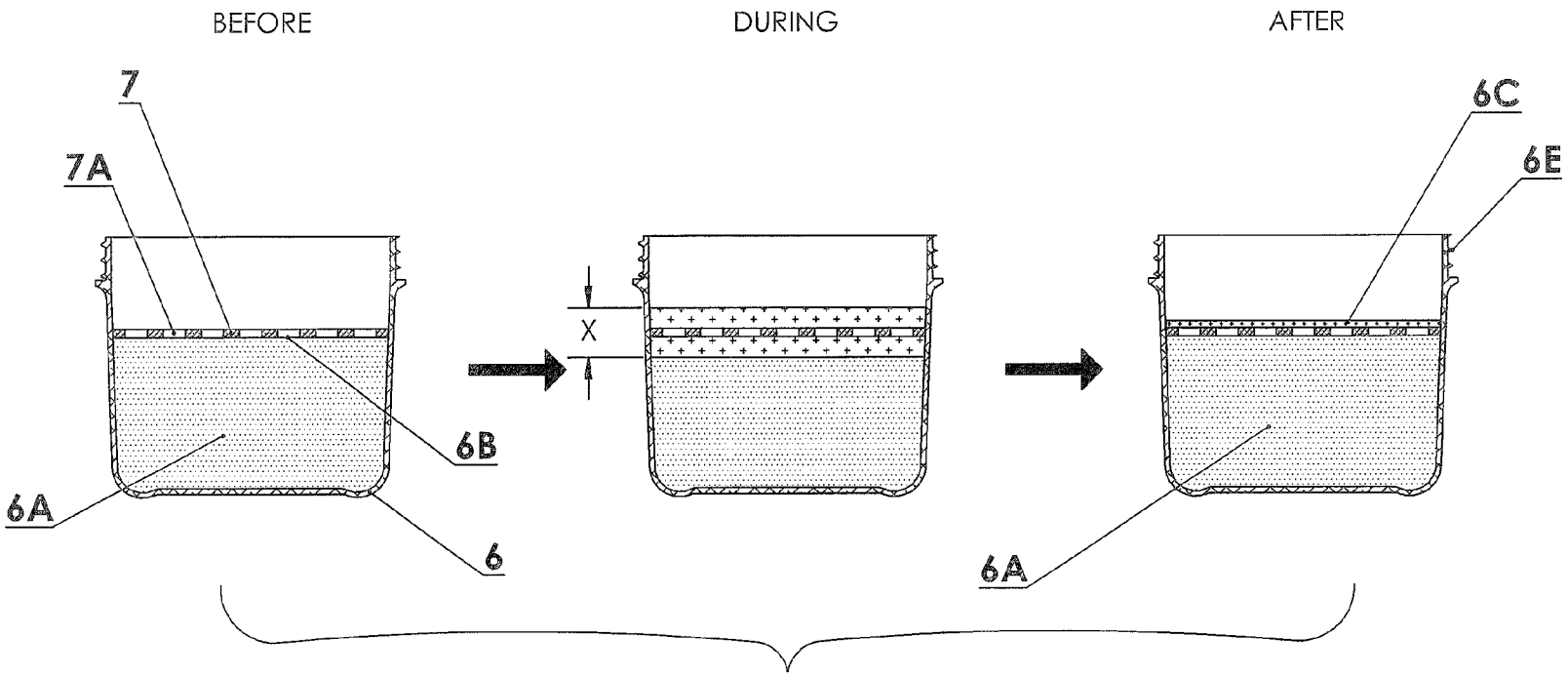
FIG. 4 illustrates the stages that a product within a product cup undergoes during a single heating cycle.

Referring to FIG. 4, the stages that the product undergoes during a heating cycle are illustrated. The region or volume within the product cup that is only heated during each stage of a heating cycle is the "heat affected product zone" indicated as (X). It is emphasized that this is a key focus of the present invention because only the product in the "heat affected product zone" is heated and not the entire product which would diminish effectiveness of the product over time. In the product cup marked "Before", a cross section containing unheated product (6A) is shown with a target member resting on an upper surface (6B) of the product (6A). In the product cup marked "During", the product is heated in the heat affected product zone (X), which is the region immediately above, below, and including the target member in which the product becomes heated and staged for the user. During this stage, as the heating cycle begins, an electromagnetic field passes electromagnetic energy within the target member (described in more detail hereinafter) thereby heating the target member. Heat then transfers to the product that is in contact with the target member. The heated product melts or liquefies and then flows through the target member through-passages (7A) to the upper surface of the target member (7). The heated product located on the upper surface of the target member is then ready for stirring and/or gathering such with a brush, scraper or fingers by the user. During the heat cycle the target member may descend though the product due to gravity or may rely on the downward force by the user. In the product cup marked "After", the induction heating cycle has ended and the product and target member begin to cool. As a result the viscosity of the product increases and in some instances the product returns from a liquid state to a solid or gelatinous state. Also, after the product has cooled, a residual layer of product (6C) will remain on the upper surface of the target member (7).

Figure 5B:
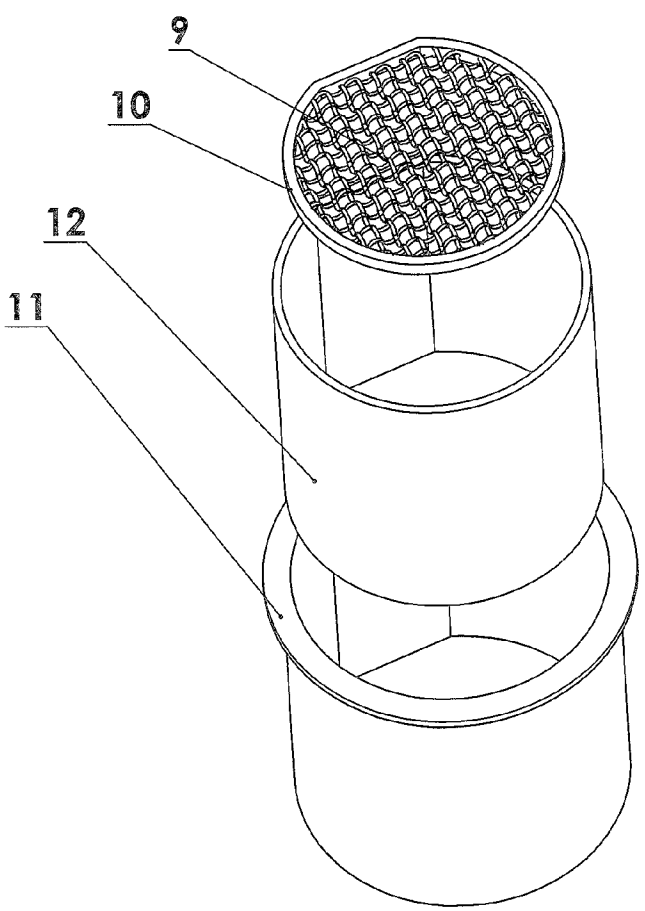
FIG. 5B is an exploded view of the second embodiment of the present invention illustrated in FIG. 5A.
Figure 5A:
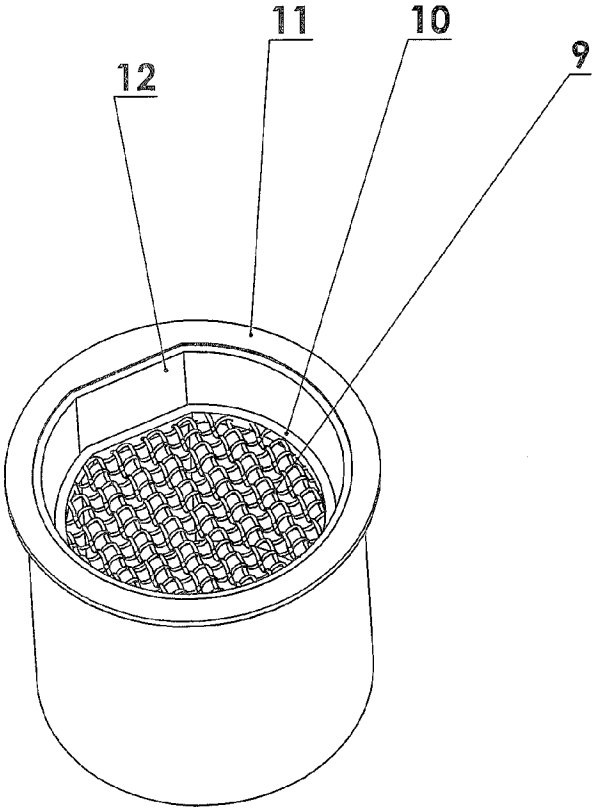
FIG. 5A is a perspective view of a second embodiment of the present invention illustrating an assembled induction receptacle, product cup and target member comprising a screen bound by a floatation ring.

Referring to FIGS. 5A and 5B, the embodiment illustrated includes a target member (9) illustrated as an electrically conductive metallic screen and floatation device (10) removably inserted within product container (12), which is removably inserted within induction receptacle (11). The product container (12) does not include an upper outwardly extending flange or threaded extension as does the product container (6) in FIGS. 1-4. In this embodiment, a plug-type of closure (not shown) is used to close the product container for storage. The induction receptacle (11) and product container (6) are modified with a non-circular geometry. In particular, each component has at least one flat surface for aligning the components in assembled position and preventing rotation while collecting the product onto the applicator. Although this embodiment is shown to have flat surfaces, any other configuration could be employed to align and prevent rotation of the components during use.

Figure 6:
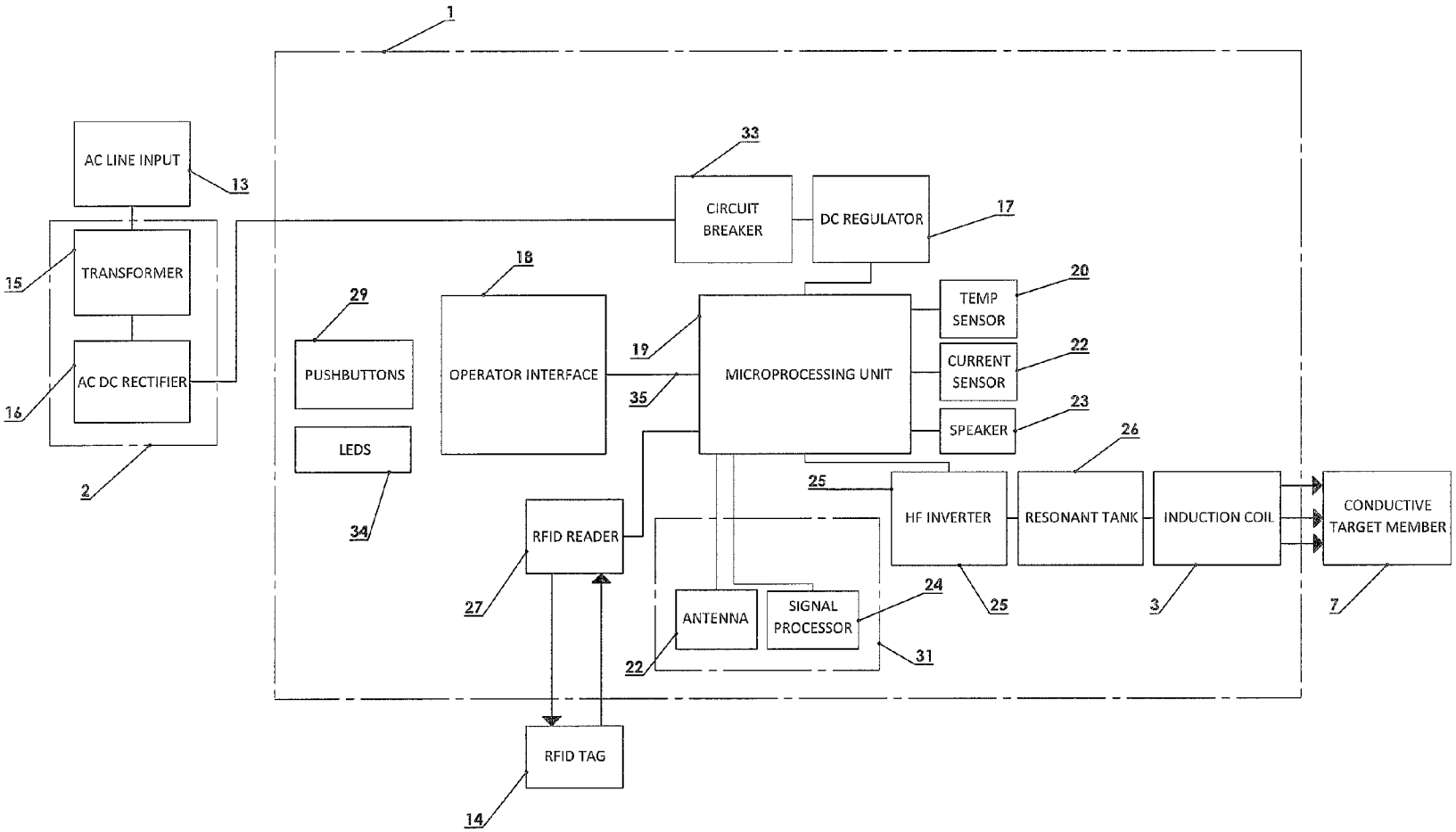
FIG. 6 is a circuit block diagram of the electronic system of the present invention.

Referring to FIG. 6, a circuit block diagram of the present invention is illustrated. A standard wall outlet AC line input (13) is connected to a standard electromagnetic transformer (15) and AC to DC rectifier (16) enclosed within the housing (2) to power the components. The system further includes a standard DC circuit breaker (33) and regulator chip (17) that lowers the voltage to power the sensitive digital components. An operator interface (18) is accessed by window (5) shown in FIGS. 1-3, 8 and 9 enabling a user to interact with the device. A microprocessor unit (19) controls level of electromagnetic energy in the resonant tank (26) described in further detail hereinafter to an induction coil (3). The induction coil (3) is disposed adjacent the induction receptacle (4) shown in FIG. 3. The conductive target member (7) is disposed within the product container (6) that is removably received within the induction receptacle (4). The microprocessor (19) varies the level of heat energy induced into the conductive target member (7) by adjusting the oscillation frequency in the HF converter (25) by means of pulse width modulation (PWM). The microprocessor (19) also controls the operator interface (18), temperature sensor (20), current sensor (21), antenna (22), signal processor (24), RFID reader (27) and electro-acoustic transducer (23). The temperature sensor (20) is capable of reading the internal board component temperatures of the microprocessor as well as the temperatures of the induction coil windings. The current sensor (21) is configured to measure the current draw through the switching circuit within the microprocessor. The antenna (22) can be any conventional type such as a dipole, helical, periodic, loop, etc., and is configured to receive information from remote modules or transmit data to an external remote control device, for example, via Bluetooth technology. The electro-acoustic transducer (23) can be any conventional type, such as a speaker, capable of producing warnings such as over-heating temperatures or other helpful aids to the user throughout the heat cycle. It may also provide instructions during the product application. The transducer may also be configured in such a manner that it records electrical-mechanical pulses and is read by a signal processor (24). The signal processor (24) is a standard signal-processing unit used to decode information received from antenna (22) and transmits information via the electro-acoustic transducer (23). The HF inverter (25) converts DC power to high frequency AC by means of receiving pulse width modulated signals from the microprocessor (19) and receiving high levels of DC power from rectifier (16). The high frequency AC generated by inverter (25) is then passed into a series, parallel, quasi-series, or quasi-parallel resistor, capacitor, and inductor network called a Resonant Tank (26). Tank (26) has a resonant frequency determined by the resistor, inductor, and capacitor (RLC) configuration therein. As current passes through the resonant tank (26), it travels through the induction coil which is a large wound conductive copper induction coil shown as element (3) in FIGS. 1 and 3, as element (3A) in FIG. 8, and as element (3B) in FIG. 9. The RFID reader (27) is mounted within the main housing (1) in close proximity to the bottom of the induction receptacle (4, 4A and 11) in order to communicate with the RFID tag (14) on or in the bottom of the product container (6, 6A or 12). The Resonant Tank (26) frequency is optimized through means of electrical reprogramming and tuning carried out by the microprocessor (19) and high frequency inverter (25). The optimization of the resonant tank is achieved by user input and/or information generated by the RFID tag (14) located on the product cup. This system allows the device to deliver precise amounts of current into the induction coil (3) to heat the "conductive target member" (7), which also limits the system from overheating the various components of the system. During the heat cycle and during non-heating idle time the microprocessor (19) monitors the current sensor (21) and temperature sensors (20) to ensure safe operation of the device. The coil is not visible to the outside of housing (1) and surrounds induction receptacle (4) and nested product container (6) with target member (7) resting on the top surface of the product within product container (6). Thus, the target member (7) is closely positioned with respect to the coil (3), which creates an electromagnetic field that passes electromagnetic energy into the conductive target member (7). By this process, the target member only is heated by the electromagnetic energy, which is then transferred to the "heat affected product zone" (X) within the product container. It is again emphasized here that the target member only and not the induction receptacle and product container is heated by the electromagnetic energy. The power supply components as described supra is not intended to be limited as will be described hereinafter.

Figure 7:
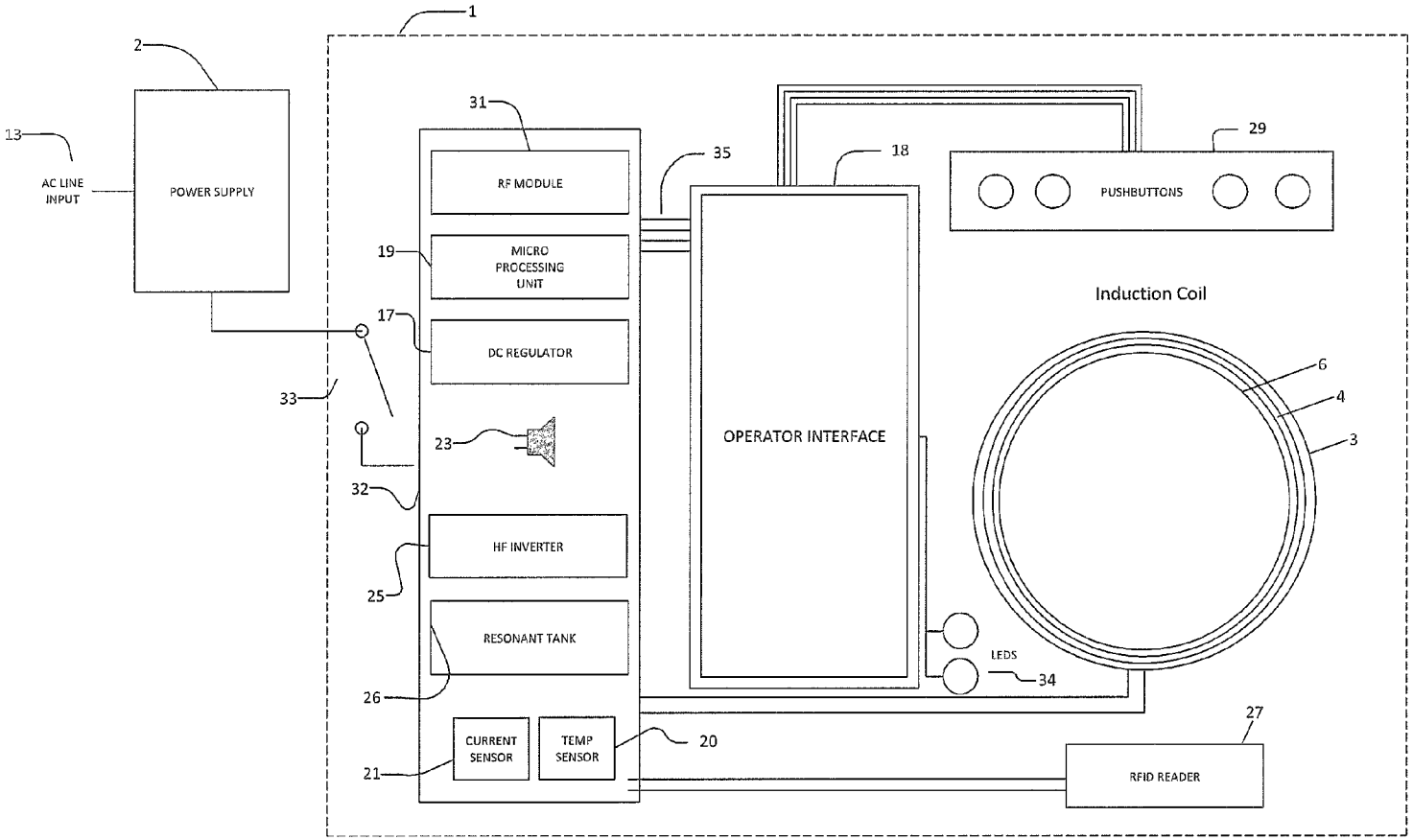
FIG. 7 is a perspective view of the actual arrangement of components within the present invention.

Referring to FIG. 7, a perspective view of how the components illustrated in FIG. 6 are arranged in main housing (1). The RF module (31), which comprises the antenna (22) and signal processor (24) seen in FIG. 6, microprocessing unit (19), DC regulator (17), HF converter (25), resonant tank (26), speaker (23), current sensor (21), temperature sensor (20) are mounted on a main board (32). Power is fed in from a standard electrical wall outlet mains AC at (13). Power fed in is received by power supply (2) which includes transformer (15) and AC-DC rectifier (16) where it is converted into DC power and sent to the remaining components via the DC regulator (17) located on the main board (32). A circuit breaker (33) is utilized as a safety fault in the event of a large current consumption by the device. The operator interface (18) connects into the main board by means of a multi-conductor cable harness (35). The RF module (31) transmits and receives information through antenna (22). Data received and sent passes through a signal processing unit (24) to microprocessor (19). The main board (32) is controlled by microprocessing unit (19). Low voltage DC power is converted from high voltage DC by means of a DC regulator IC chip (17) located on the main board (32). The RFID reader (27) is mounted within housing (1) in close proximity to induction receptacle (4) for communicating with RFID tag (14).

Figure 8:
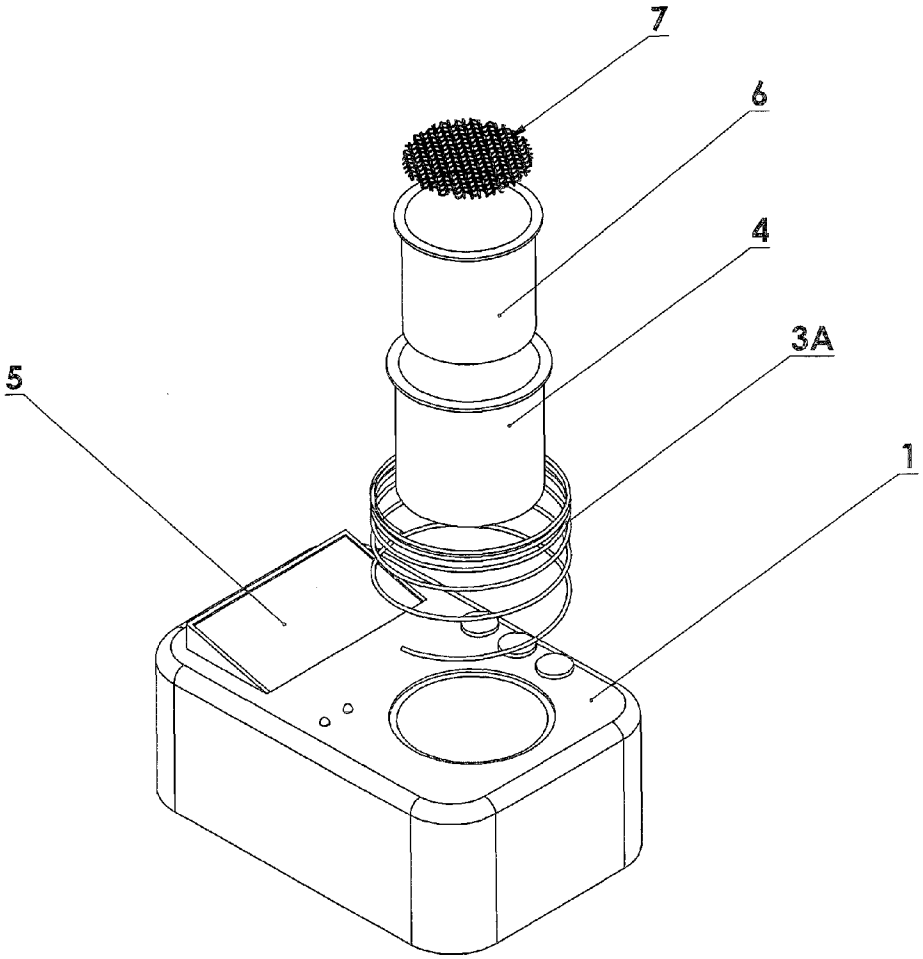
FIG. 8 illustrates an exploded view of a third embodiment of the present invention similar to the first embodiment but with a rectangular-shaped housing and modified cylindrical induction coil configuration.

Referring to FIG. 8, a third embodiment of the present invention is illustrated which is similar to the embodiment illustrated in FIG. 1 with the exception of induction coil (3A) and shape of the main housing (1). The induction coil illustrated in FIG. 2 is configured to have even windings from top to bottom. However, the configuration of the induction coil may be arranged or formed to meet different requirement per product. The embodiment illustrated in FIG. 1 shows an induction coil (3) formed into an evenly pitched helix for relatively even heating of the target member (7 or 9) as it descends from the top of the product container (6) to the bottom. The embodiment illustrated in FIG. 8 shows the induction coil (3A) wound with variable pitch allowing for variable heating as the target member descends in the product cup from the top to the bottom. This may advantageously be used to increase, decrease, or make even the heating as the target member descends though the coil. This embodiment may further provide the user with product heated to a higher level when the product container is full. As the product diminishes, the level of heat is reduced to avoid damaging the product from overheating. Thus, the user is provided with uniformly heated product throughout the entirety of product within the product container. It is well known that despite even coil pitch the flux lines of energy may be denser in certain areas, specifically towards the center height of the helix coil. This may be offset by varying the pitch of the helix only in this area. Alternatively, heat generated within the target member may be controlled by indirectly measuring the inductance of the system and varying the frequency thereof. Most preferably, the present invention utilizes the unique RFID tag associated with each product cup, associated with each target member, to properly regulate the parameters that relate to the heating cycle. In this embodiment, the main housing has a rectangular shaped housing having interface (5) located on a top surface thereof.

Figure 9:
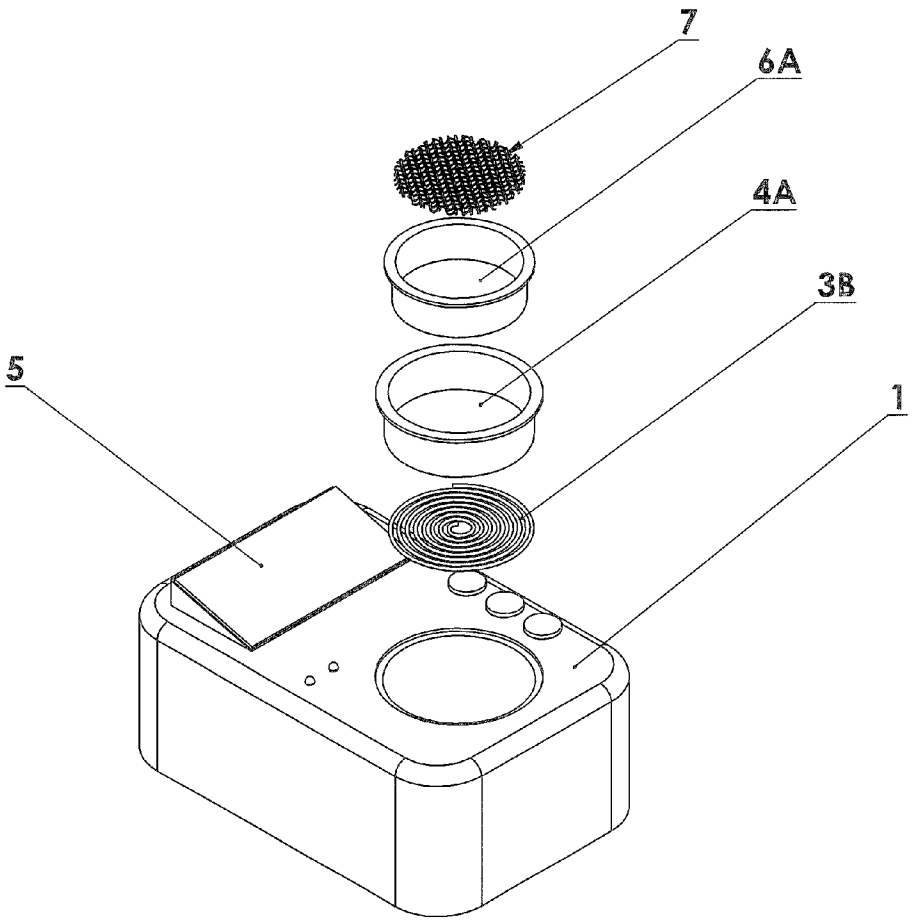
FIG. 9 illustrates an exploded view of a fourth embodiment of the present invention having a modified induction receptacle and product cup and a modified coil configuration.

Referring to FIG. 9, a fourth embodiment of the present invention is illustrated which is similar to the embodiment illustrated in FIG. 8 with the exception of the induction coil (3B), which is formed as a pancake coil. Also, the induction receptacle (4A) and product container (6A) have an overall depth much less than the induction receptacles and product containers of the previous described embodiments. All other components are the same as those of the embodiments illustrated in FIG. 2 or 8. The effective height of the electromagnetic field generated by the pancake coil (3A) is much less than that of the cylindrical coils of the previous embodiments thus taking into account the lesser overall depth of the product receptacle (4A) and product container (6A). In other words, the effective distance of the electromagnetic field generated by the pancake coil (3A) is sufficient to heat the target member disposed at an upper region of the product within the product container of lesser height.

Figure 10B:
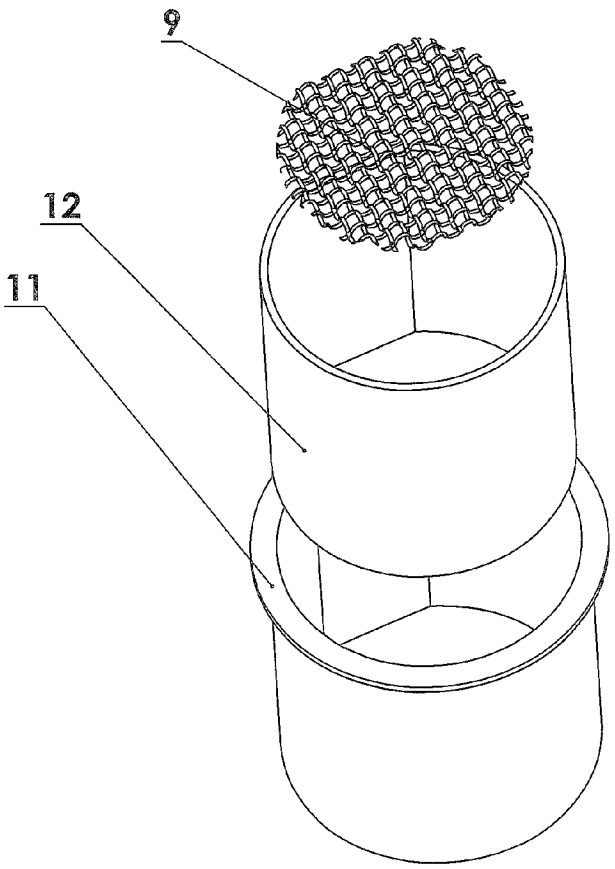
FIG. 10B is an exploded view of the fifth embodiment of the present invention illustrated in FIG. 10A.
Figure 10A:
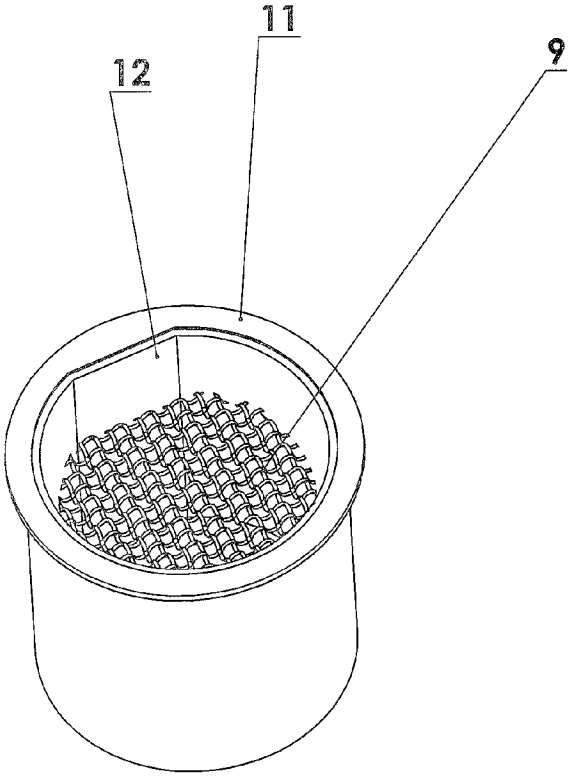
FIG. 10A shows perspective view of a fifth embodiment of the present invention similar to the second embodiment illustrated in FIG. 5A wherein the floatation ring is eliminated.

Referring to FIGS. 10A and 10B, the embodiment illustrated is similar to the embodiment illustrated in FIGS. 5A and 5B. The target member (9) is removably inserted within product container (12), which is removably inserted within induction receptacle (11). The components of this embodiment are similar to those shown in FIGS. 5A and 5B with the exception that the target member does not include a floatation ring. The target member (9) comprises geometry to nest within the product container (12), which comprises geometry to nest within the induction receptacle (11). In this variant, the assembly is comprised of an asymmetrical geometry about a medial plane to prevent the rotation of the target member when stirred or agitated. The product container is between 2 and 5 inches (5.08 and 12.7 cm) deep requiring use of coils along the sides of the induction receptacle. In particular, the cross-section of each component has at least one flat side surface for aligning the components in assembled position and preventing rotation while collecting the product onto the applicator. Although this embodiment is shown to have flat side surfaces, the cross-sectional configuration of each component could be of any geometric shape to align and prevent rotation of the components during use.

Figure 11B:
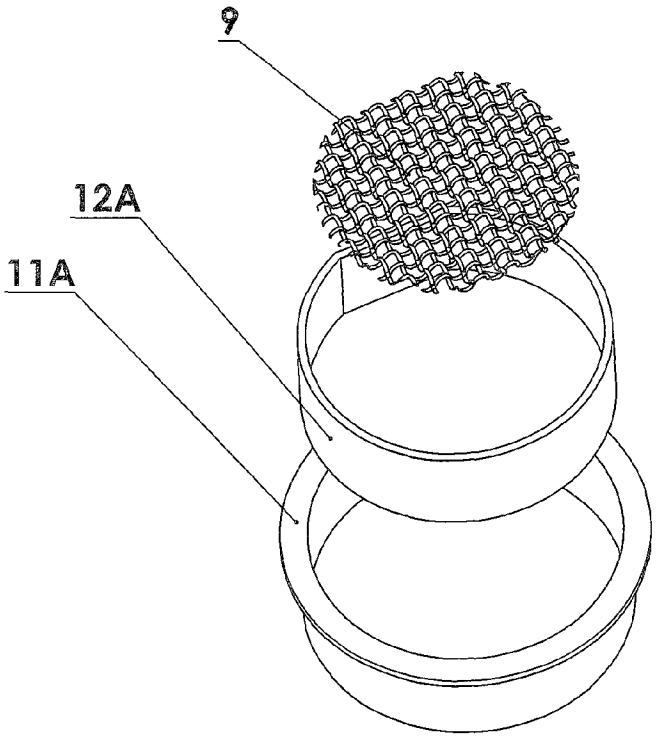
FIG. 11B is an exploded view of sixth embodiment of FIG. 11A.
Figure 11A:
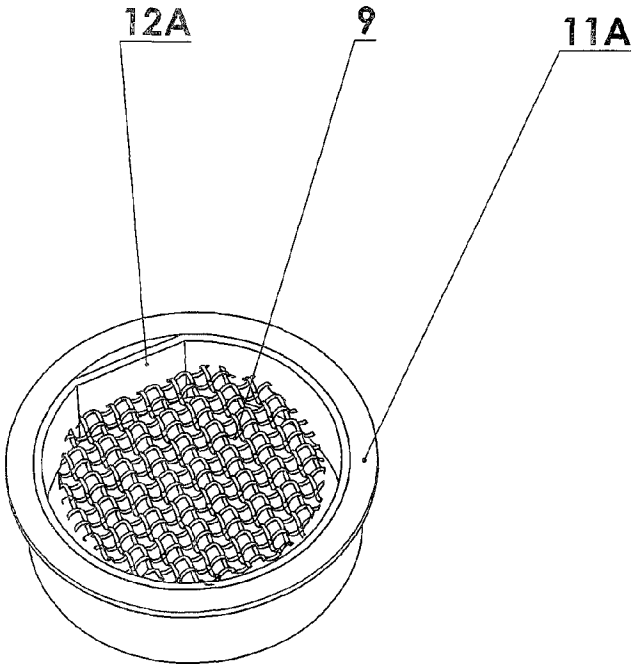
FIG. 11A shows a perspective view of a sixth embodiment of an induction receptacle, product cup and target member usable with the fourth embodiment illustrated in FIG. 9.

Referring to FIGS. 11A and 11B, the alternative embodiment illustrated includes a target member (9) illustrated as an electrically conductive metallic screen removably inserted within product container (12A), which is removably inserted within induction receptacle (11A). This embodiment is to be used with the pancake coil in the embodiment illustrated in FIG. 9. The components of this embodiment are similar to those shown in FIGS. 5A, 5B, 10A and 10B with the exception that the target member does not include floatation ring and the overall depth of the induction receptacle and product container is less. In this embodiment, the product container (12A) is between 0.500 and 2 inches (1.27 and 5.08 cm) deep requiring use of the pancake coil along the bottom of the induction receptacle. This provides opportunity for the user to introduce product as needed into the product container or to have a greatly reduced starting sample size. As in the previous embodiments, the cross-section of each component has at least one flat side surface for aligning the components in assembled position and preventing rotation of the target member while collecting the product onto the applicator, and the cross-sectional configuration of each component could be of any geometric shape to align and prevent rotation of the components during use.

Referring to FIGS. 12-19, alternative to the electrically conductive screen type target member illustrated in the embodiments described above, other embodiments of target members are shown that can be employed in each of the embodiments described supra. Applicants have discovered that by varying the construction of the target member, the heating pattern on the target member can be modified. Each target member illustrated in FIGS. 12-19 comprises a solid metallic disc member having an outer peripheral surface (51), an upper surface (52) and a lower surface (53). The peripheral surface (51) is where heat originates due to the concentration of flux lines from a cylindrical coil such as seen in FIGS. 2 and 8. The top surface (52) provides the surface area that that the user will interface with. The bottom surface (53) is the area or region that first provides heat to the product.

As illustrated in FIGS. 12 and 12A, target member (35) comprises a solid metallic disc member having an outer peripheral surface (51), an upper surface (52) and a lower surface (53). A plurality of evenly distributed holes or through-passages (37) extend therethrough and are located in spaced relation between the outer peripheral surface (51). In the preferred embodiment, six holes or through-passages (37) are circular and have a diameter ranging between 0.030 to 1.000 inches (0.076 to 2.54 cm), most preferably between 0.030 and 0.400 inches (0.076 and 1.016 cm). In this embodiment, heat is propagated from the outer peripheral surface towards the center axis of the target member. As the target member is energized by electromagnetic field from the induction coil, the heat generated in the target member (35) is focused in the peripheral region indicated by the cross-hatching (36).

Referring to FIG. 13, target member (39) comprises a solid metallic disc with peripheral, upper and lower surfaces (not numbered). In this embodiment, the target member includes through-passages comprised of four radially extending slots (40) dividing the disc into four separate quadrants (42) having slots (41) each connected by a central section (43). Each quadrant includes a centrally disposed slot (41) having sharp and/or rounded corners. This embodiment provides an increased rate of heat transfer within the conductive material from the heat region (44) to the center of the target member due to the absence of material and also by the outer slots (40) that direct the eddy current along the peripheral surface towards the center. The slots (40) and (41) extend entirely through the disc from the upper surface to the lower surface. In this embodiment, as the target member is energized by electromagnetic flux from the induction coil, the heat generated in the target member (39) is focused in the areas indicated by the cross-hatching (44).

Figure 14:
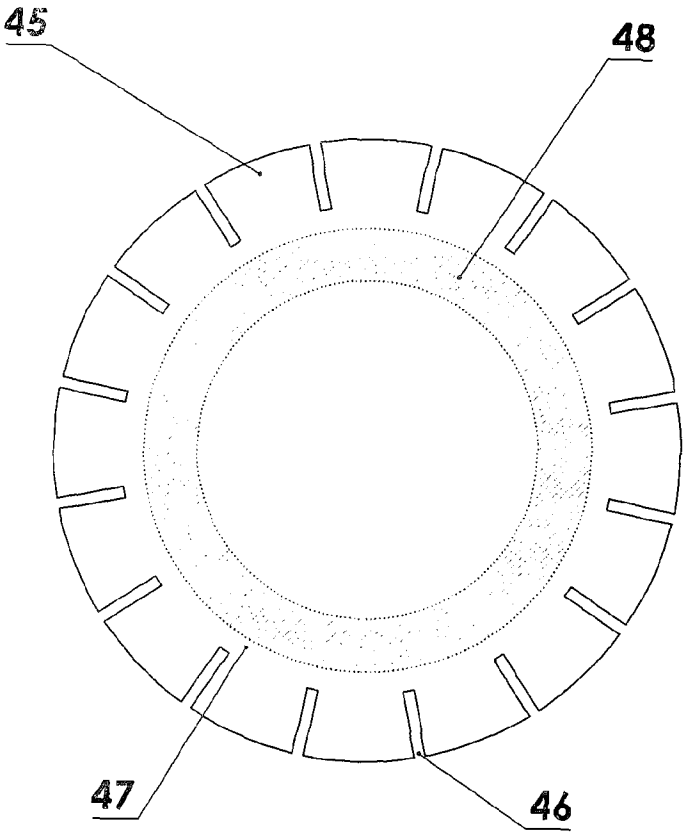

Referring to FIG. 14, target member (45) comprises a solid metallic disc with peripheral, upper and lower surfaces (not numbered). In this embodiment, the target member includes through-passages comprised of radially extending square-shaped slots (46) spaced equidistant from each other. Each slot extends inwardly from the peripheral surface to a point in the peripheral region (47) of the disc. These square slots are comprised of only straight walls and 90-degree angles to propagate the heat zone (48) inward from the periphery of the target member. This assists in more even heat distribution through the target member.

Figure 15:
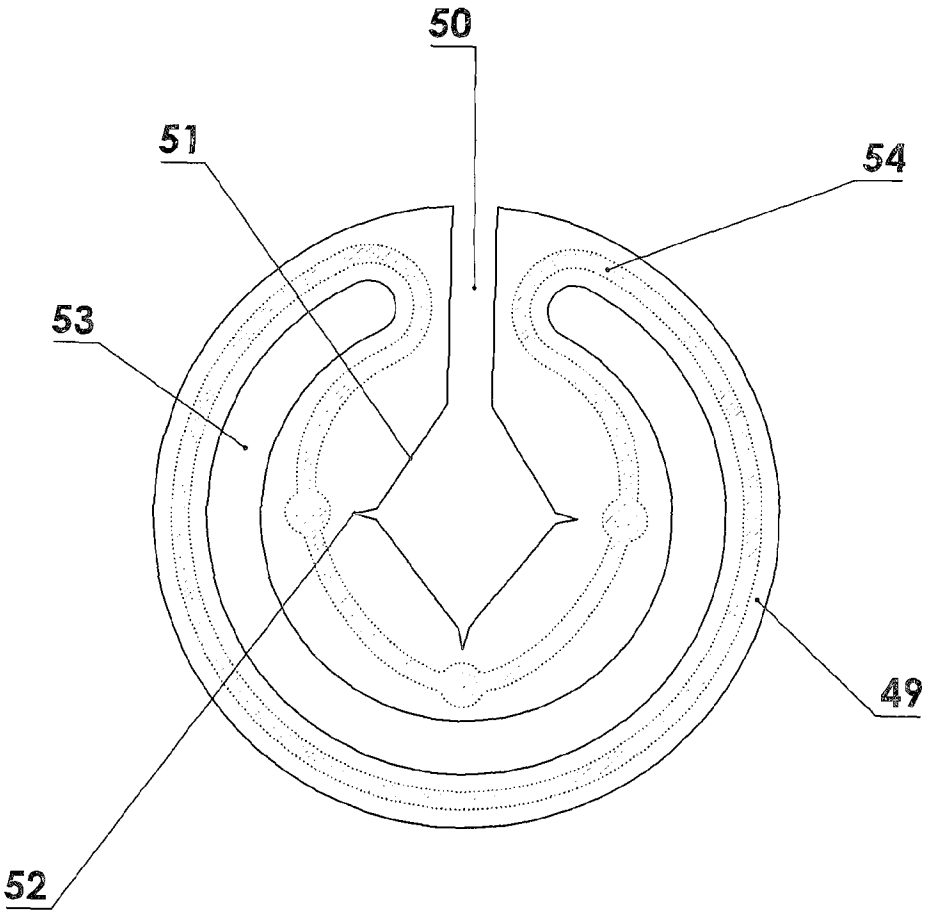

Referring to FIG. 15, target member (49) comprises a solid metallic disc with peripheral, upper and lower surfaces (not numbered). This embodiment includes through-passages comprised of radially extending slot (50) and crescent-shaped slot (53). Slot (50 extends from the peripheral surface to one corner of a central diamond-shaped cutout (51). Except for the corner where the slot (50) enters the diamond-shaped cutout, the remaining corners are formed with pronounced peaks (52). Crescent-shaped slot (53) surrounds the slot (50) and diamond-shaped cutout (51). The slots (50) and (53) and diamond-shaped cutout (51) extend entirely through the disc from the upper surface to the lower surface. The remainder of the disc is solid. In this embodiment, as the target member is energized by electromagnetic flux from the induction coil, the heat generated in the target member (49) is focused in the regions indicated by the cross-hatching (54).

Figure 17:
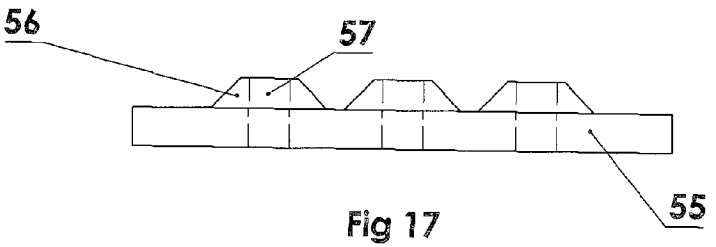
Figure 16:
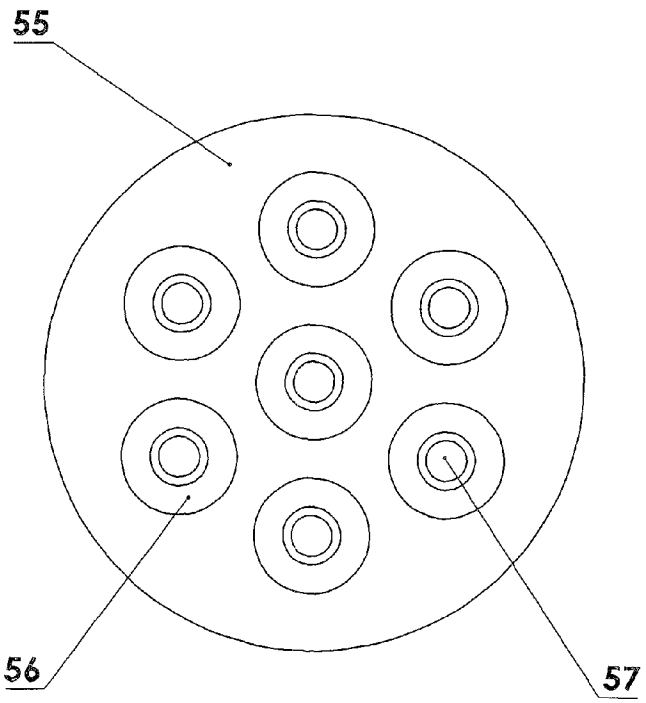

Referring to FIGS. 16 and 17, target member (55) comprises a solid metallic disc with peripheral, upper and lower surfaces (not numbered). In this embodiment, the target member (55) is similar to the target member illustrated in FIG. 12 and therefore, would have the very similar heat distribution. However, this embodiment differs from that of FIG. 12 in that each hole (57) is surrounded by an upstanding conical member (56). The upstanding conical members facilitate agitation and lathering of the melted product as it flows through holes or through-passages (57) and collected by the user such as by a shaving brush. Each conical member extends between 0.010 and 0.250 inches (0.0254 and 0.635 cm) from the upper surface of the target member. Each hole (57) may be between 0.020 and 0.750 inches (0.05 and 1.9 cm) in diameter. In this embodiment, although no cross-hatching is shown, as the target member is energized by electromagnetic flux from the induction coil, the heat generated in the target member (55) is focused in the same region indicated by the cross-hatching (36) in FIG. 12.

Figure 19:
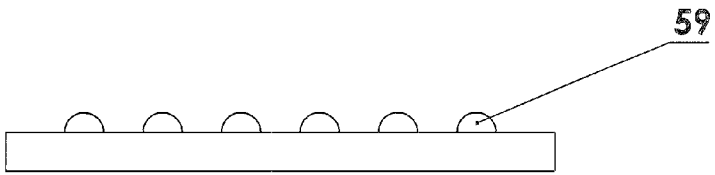
Figure 18:
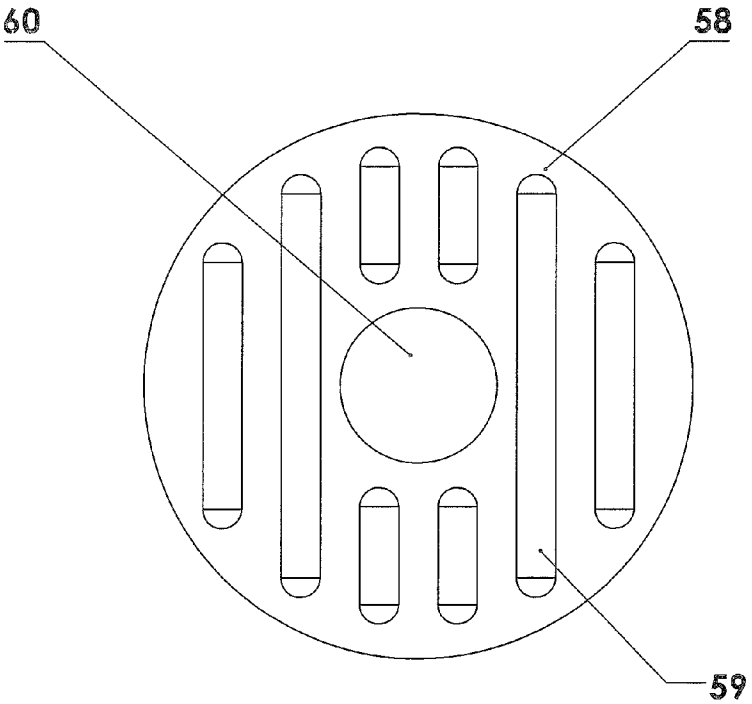

Referring to FIGS. 18 and 19, target member (58) comprises a solid metallic disc with peripheral, upper and lower surfaces (not numbered). In this embodiment, the target member (58) includes a through-passage comprised of a single central large hole (60) extending therethrough from the upper surface to the lower surface. A plurality upstanding ribs (59) are evenly disposed on the upper surface. The upstanding ribs provide agitation to the melted product as it flows through hole (60) to create lather when the melted product is collected by the user such as by a shaving brush. In this embodiment, although no cross-hatching is shown, as the target member is energized by electromagnetic flux from the induction coil, the heat generated in the target member (58) is evenly focused about each of the upstanding ribs (59).

Figure 20:
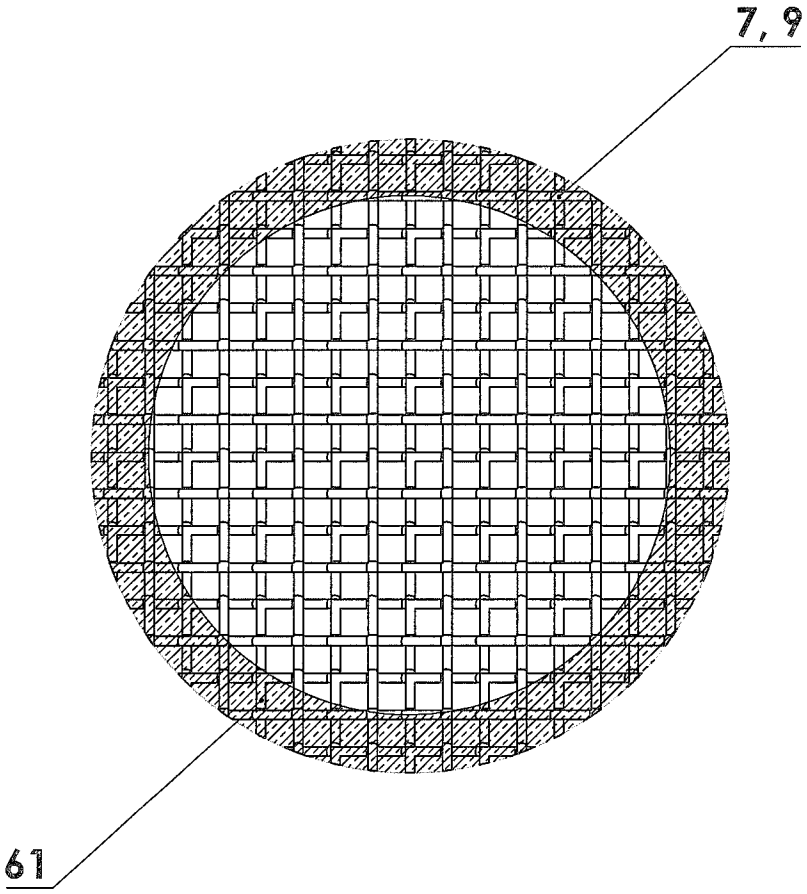

Referring to FIG. 20, the target member illustrated is the conductive metallic screen (7 or 9) shown in the embodiments of FIGS. 1 and 8-11. The screen is comprised of woven strands of electrically conductive material, preferably aluminum or stainless steel. The woven strands are between 0.010 and 0.070 inches (0.0254 and 1.778 cm) in diameter with an open area between 20 and 85 percent of the whole area. The interstices between the woven strands constitute through-passages for heated and/or melted product to flow through the target member. The heat zone (61) propagates from four outer peripheral regions towards the center. These four outer peripheral regions are located at the points on the peripheral surface where the longest strands intersect the peripheral surface. The contact points of the strands are preferably joined to facilitate even distribution of the heat zone. The varying topology of the top surface of this embodiment provides the user with an area that is highly advantageous for creating lather. In this embodiment, as the target member is energized by electromagnetic flux from the induction coil, the heat generated in the target member is focused about its peripheral region as indicated by the cross-hatched area (61).

Although only indicated in FIG. 12A, all the target members illustrated in FIGS. 12-19 have a material thickness (h) ranging between 0.005 and 0.150 inches (0.0127 and 0.0381 cm), most preferably between 0.008 and 0.020 inches (0.020 and 0.050 cm), and a width (w) ranging between 2 and 4 inches (5.08 cm and 10.16 cm). The various target member configurations illustrated in FIGS. 12-19 provide differing heating characteristics by changing or interrupting the side surface (51) profile, or target member surface that is parallel to the cylindrical coil wall, of the target member. Depending on the application and heating requirement, some target members have more total surface area to provide more contact with the product, and thus faster heating of the product. The varying top surface (52) topography of each target member in conjunction with the viscosity of the product may significantly impact the rate at which the target member descends though the product. Additionally, the varying top surface topography provides opportunity for aeration. For applications requiring agitation or aeration the top surface topography of the target member possess more variance. The size and number of openings are also advantageous in providing agitation of the product for applications requiring lather, such as shaving soaps. The present invention may simultaneously utilize one or more target members composed of any of the following types of steel alloy, carbon, tool, or stainless and may be of the ferritic, martensitic, and/or austenitic grain structure. Additionally, and preferably, the target member may be of any of the SAE designated aluminum types. Aluminum, generally non-compatible with household induction heaters/cookers, provides corrosion resistance, a very low heat capacity, and high thermal conductivity as compared to other materials that work with household induction cooking/warming systems. The low heat capacity of the aluminum allows the target member to raise temperature quickly and also to cool quickly once the cycle has ended. This in turn allows the product to return to its original state more quickly than would one of the steel grades that retains more heat. A target member comprised of a material with a high heat capacity would descend downward towards the bottom of the product cup even after necessitating use due to the excess heat held within the conductive material. The high thermal conductivity of the aluminum target member is advantageous in transferring the heat generated by the eddy current to the product as quickly as possible. As a result of the high thermal conductivity and low heat capacity, the energy from the electromagnet field is instantaneously transferred to the product, in the form of heat, with minimal dwell time in the target member.

Figure 21:
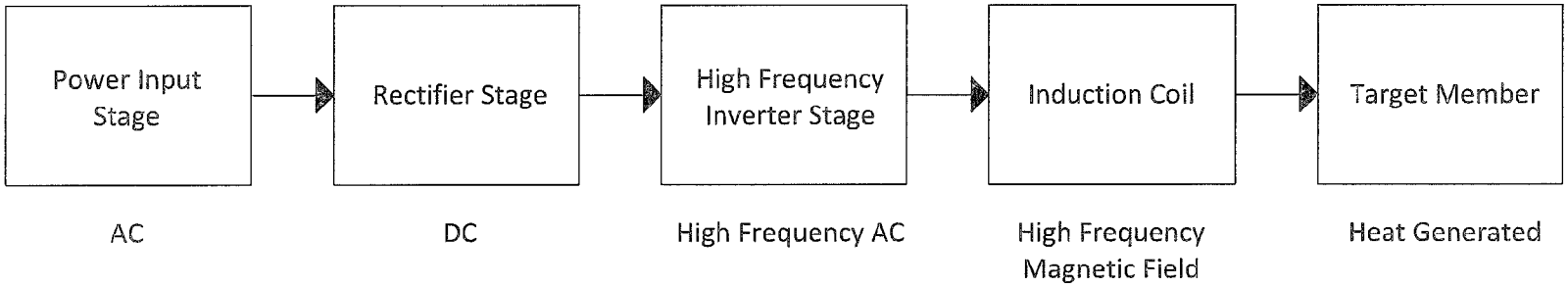
FIG. 21 shows a high level flowchart demonstrating the process by which the input power is transferred to the target member.

The block diagram illustrated in FIG. 21 shows the process for transferring power from its origin to heat energy within the target member. As illustrated in FIG. 6, the Power Input Stage is in the form of alternating current as commonly sourced by the wall outlet in residential and/or commercial buildings. This alternating current passes into a rectifier stage whereby it is converted to direct current. This stage is not intended to be limiting but rather showing one suitable option. For example, the transformer and rectifier may be incorporated into the microprocessor unit. In other embodiments the AC line may be eliminated and replaced with a battery. The direct current is then converted back to a high frequency alternating current by any common oscillator circuit whether digital or analog. The high frequency alternating current then creates an electromagnetic field that generates eddy current within the target member and thus creating heat.

Figure 22:
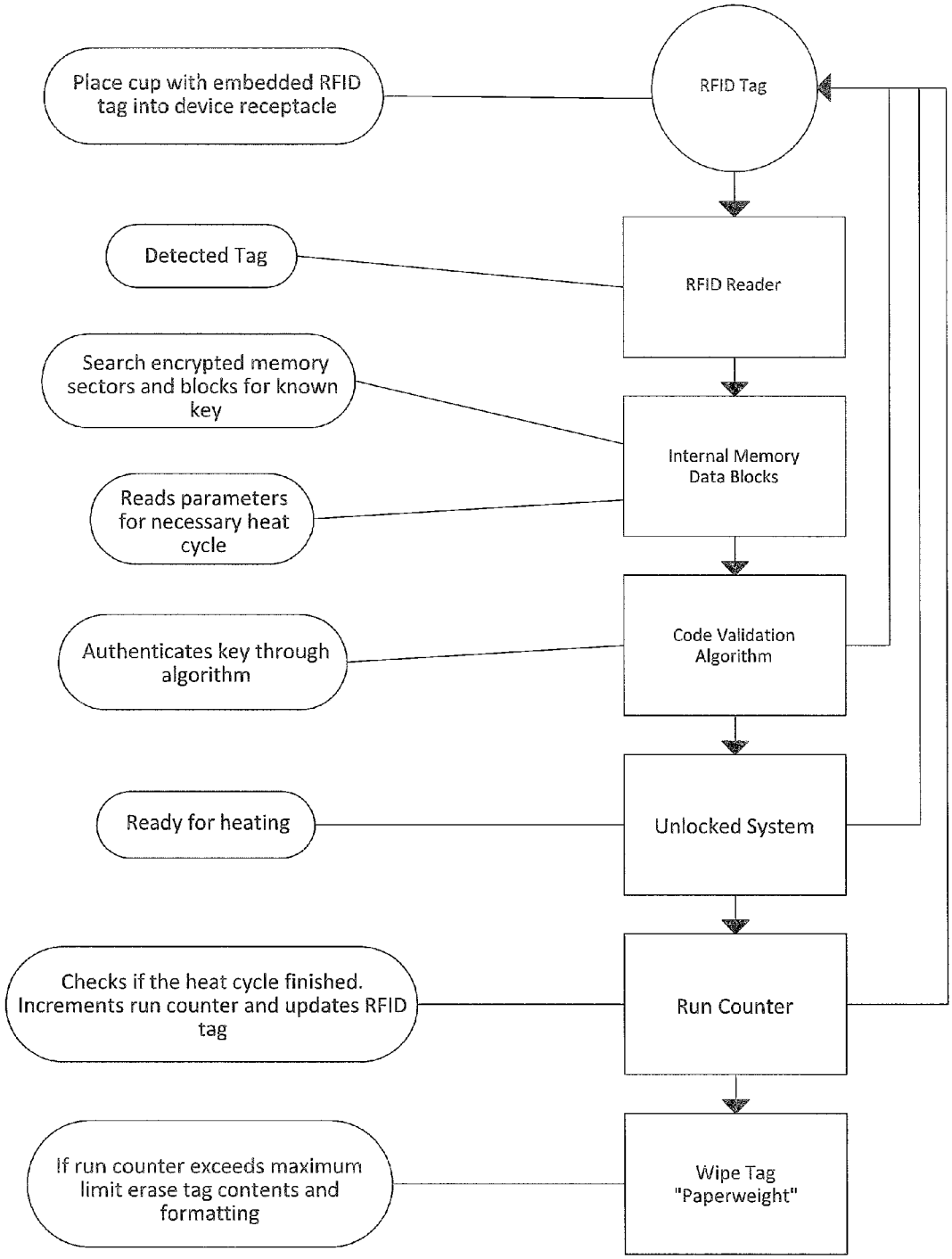
FIG. 22 shows a flowchart of the decision making process of the present invention.

The diagram in FIG. 22 shows a decision making process related to the RFID system. A unique RFID tag (14) is attached to each product cup and has been pre-programmed with information used by the present invention for optimizing the induction heating cycle for the given product. After detection, the RFID reader reads the information on the RFID tag found on the internal memory blocks within the RFID tag and provides that information to the microprocessor. This information includes product type, heat cycle duration, heat level required, and induction values needed for optimization of the induction cycle, such as frequency. The system then runs the validation algorithm to determine that the RFID tag is a valid tag. This step is incorporated as a safety measure. After completing these steps, the system unlocks the system and alerts the user that the heat cycle may activated. After a given number of cycles has been run the RFID tag associated with the product cup is modified by the induction system microcontroller to provide information such as number of cycle run, duration of cycles, date, and/or other information related to product usage. Additionally, the system may render the RFID tag incapacitated for future use.

Operation of the induction heating system of the present invention is as follows. AC power supply (13) is connected to the system. Voltage received is then electromagnetically reduced by transformer (15) and converted into direct current (DC) waveform by rectifier (16). Transformer (15) and rectifier (16) may be packaged together externally in an AC to DC power supply commonly used by computers or electronic devices. Inside the device the rectified DC power is passed through DC regulator (17), a monolithic integrated circuit regulator that steps down the voltage to TTL, CMOS, ECL levels etc. The induction heater coil (3) is controlled by the microprocessor (19), which also controls the timing and frequency of the HF inverter (25), sensors (20), (21), operator interface (18), led lights (34), timers, antenna (22), speaker (23) and RFID reader (27). The microprocessor (19) may also be used to interact with many other device peripherals if needed. The microprocessor is programmed to control and vary the oscillation frequency in order to reach electromagnetic resonance between the target member and the resonant tank. The microprocessor has flash memory read-while-write capabilities and EEPROM storage used in order to store user settings, timers, and safeties. Users are able to interact with the device by visually watching or pressing the operator interface (18) or user pushbuttons (29). Display of operator interface (18) is constructed of a piezoresistive, capacitive, surface acoustic, infrared grid or similar technologies. It allows the user to press and start a heating cycle while displaying helpful information based on the temperature or duration of the cycle. Safety information can be depicted on this display or any other helpful visual aids. In addition to operator interface (18), a speaker (23) is used to provide audible feedback and alerts to the user based on the state of the heat cycle. The pushbuttons (29) are used as a secondary source of user input. Nearby LEDs (34) are used to provide a secondary visual indication of the state of the device. Pushbuttons, LEDs, and the Operator Interface may be reprogrammed by the manufacturer in order to adjust the functionality and usability throughout different device revisions. Once a heat cycle is initiated, the microprocessor (19) inputs a low voltage pulse width modulated (PWM) signal received by the high frequency (HF) inverter module (25). The inverter module switches the rectified DC power from rectifier (16) to HF alternating current power at the oscillation frequency set by the microprocessor (19). High frequency AC power is then passed into a series or parallel resonant RLC tank. The tanks capacitance, inductance, and resistance are optimized to reach the resonant frequency of the PWM signal. This resonance also matches the oscillation frequency of the target members illustrated in FIGS. 12-20. Throughout the heat cycle, current transferred into each target member is measured by sensor (21). At this time, microprocessor (19) adjusts the oscillation frequency in order to transfer maximum power into the target members. If the current exceeds a safety limit measured by sensor (21), the device shuts off the heat cycle. Likewise, the temperature of the internal components is measured by sensor (20). This prevents the device from being left on throughout the day or operating in harsh environments. Sensor (20) also measures the induction coil (3) temperature to prevent overheating on its internal windings. During the heat cycle high frequency currents are passed through the resonant tank (26) and into the coil (3, 3A or 3B) disposed adjacent the induction receptacle (4, 4A or 11) that receives the product container (6, 6A or 12). The high frequency currents are then transferred to the target member through means of electromagnetic induction. Eddy currents are generated inside the target member and cause a Joule heating effect as well as a heating through magnetic hysteresis. Heat generated through the target member then permeates through to the top layer of the product inside the cup. Due to the geometry of the target member, energy is transferred more directly to the "heat affected product zone" of the product inside product container (6, 6A or 12).

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An induction-heating device adapted to heat products for shaving or cosmetic purposes comprising:

a housing defining a non-electrically conductive induction receptacle;

a non-electrically conductive product container for holding shaving or cosmetic products, said non-electrically conductive product container removably received in said non-electrically conductive induction receptacle, a shaving or cosmetic product stored in said non-electrically conductive product container and defining a top product surface and a heat affected product zone consisting of a layer of said product immediately below said top product surface;

an induction coil adjacent to said non-electrically conductive induction receptacle for generating an electromagnetic field into said non-electrically conductive product container;

an electrically conductive metallic target member in said non-electrically conductive product container having a top surface and a bottom surface overlying said top product surface, said electrically conductive metallic target member having through-passages;

electronic circuitry mounted in said housing and connected to said induction coil for activating and deactivating the generation of said electromagnetic field for a predetermined time period into said non-electrically conductive product container, said electrically conductive metallic target member being heated during a heating cycle for said predetermined time period in response to said electromagnetic field to heat and or melt said product only in said heat affected product zone thereby permitting said heated and or melted product to flow through said through-passages onto said top surface of said electrically conductive metallic target member and be collected by a user for shaving or cosmetic purposes; and whereby said electrically conductive metallic target member resides in said heat affected product zone subsequent to said electronic circuitry deactivating said electromagnetic field during said predetermined time period.

2. The induction-heating device as claimed in claim 1 and further comprising:

said housing having a top surface;

said non-electrically conductive induction receptacle comprising a side wall, a bottom wall and an open top mounted in said top surface, said non-electrically conductive induction receptacle side wall defining an interior surface having a uniform cross-section from said open top to said bottom wall, said non-electrically conductive product container comprises a side wall, a bottom wall and a closable open top, said non-electrically conductive product container side wall defining an exterior surface having a uniform cross-section complementally configured to said interior surface of said non-electrically conductive induction receptacle, said non-electrically conductive product container being removably inserted in said induction receptacle.

3. The induction-heating device as claimed in claim 2, wherein said non-electrically conductive product container side wall defining an interior surface having a uniform cross-section from said closable open top to said bottom wall, said electrically conductive metallic target member further comprises a peripheral surface complementally configured to said interior surface of said non-electrically conductive product container.

4. The induction-heating device as claimed in claim 3, wherein said non-electrically conductive induction receptacle comprises a first cylindrically shaped cup and said non-electrically conductive product container comprises a second cylindrically shaped cup.

5. The induction-heating device as claimed in claim 4, wherein said electrically conductive metallic target member comprises a metallic disc having a cross-section complementally-configured to said cross-section of said interior surface of said second cylindrically shaped cup, said cross-section of said metallic disc being slightly less than said cross-section of said interior surface of said second cylindrically shaped cup thereby permitting said metallic disc to freely descend within said non-electrically conductive product container as said product is used.

6. The induction-heating device as claimed in claim 5, wherein said first and second cylindrically shaped cups and electrically conductive metallic target member are configured to maintain alignment and prevent rotation therebetween during use.

7. The induction-heating device as claimed in claim 6, wherein said first and second cylindrically shaped cups have flat sidewall sections and said electrically conductive metallic target member peripheral surface has a flat section aligned with said flat sidewall sections to maintain said alignment and prevent rotation therebetween during use.

8. The induction-heating device as claimed in claim 5, wherein said metallic disc comprises metallic screen.

9. The induction-heating device as claimed in claim 5, wherein said metallic disc comprises at least one hole extending therethrough, at least one slot extending therethrough, or a combination of at least one hole and at least one slot extending therethrough.

10. The induction-heating device as claimed in claim 9, wherein said metallic disc comprises at least one element surrounding said at least one hole and extending normal to the plane of an upper surface.

11. The induction-heating device as claimed in claim 10, wherein said at least one element is conically shaped.

12. The induction-heating device as claimed in claim 9, wherein said metallic heat conductive disc comprises at least one element located on said upper surface adjacent to said at least one hole and extending normal to the plane of said upper surface.

13. The induction-heating device as claimed in claim 12, wherein said at least one element comprises a rib.

14. The induction-heating device as claimed in claim 5, wherein said metallic disc is comprised of stainless steel or aluminum.

15. The induction-heating device as claimed in claim 5, wherein said metallic disc has a thickness ranging between 0.005 and 0.150 inches (0.0127 and 0.0381 cm).

16. The induction-heating device as claimed in claim 15, wherein said metallic disc includes a thickness ranging between 0.008 and 0.020 inches (0.020 and 0.050 cm).

17. The induction-heating device as claimed in claim 5, wherein an upper surface of said metallic disc is flat or non-flat.

18. The induction-heating device as claimed in claim 17, wherein said upper surface of said metallic disc is dish-shaped, cup-shaped or corrugated-shaped.

19. The induction-heating device as claimed in claim 4, wherein said second cylindrically 2 shaped cup has a diameter between 2 and 4 inches (5.08 cm and 10.16 cm) and a height of 3 between 0.5 to 2 times said diameter.

20. The induction-heating device as claimed in claim 1, further comprising means for supplying an alternating current source or a direct current source to said electronic circuitry.

21. The induction-heating device as claimed in claim 20, wherein said electronic circuitry includes means for generating high frequency electromagnetic energy into said electrically conductive metallic target member, said electronic circuitry further including means for regulating said alternating current or direct current to modulate the heat generated inside said electrically conductive metallic target member.

22. The induction-heating device as claimed in claim 21, wherein said means comprises a microprocessor, high frequency inverter circuit, resonant tank circuit and said induction coil.

23. The induction-heating device as claimed in claim 22, further comprising an operator interface connected to said microprocessor for permitting a user to manually start and stop a heating cycle, for adjusting the energy level and duration of heat during a heating cycle, and for displaying helpful information based on the energy level, temperature, or duration of the heating cycle.

24. The induction-heating device as claimed in claim 23, further comprising current and temperature sensors for monitoring currents and temperatures of the electronic circuitry.

25. The induction-heating device as claimed in claim 24, further comprising visual and/or acoustical alarm means responsive to said current and temperature sensors for indicating over-currents or over-heating temperatures of the electronic circuitry.

26. The induction-heating device as claimed in claim 22, further comprising an RF module for transmitting and receiving information to and from said microprocessor for remotely controlling said electronic circuitry.

27. The induction-heating device as claimed in claim 26, further comprising a speaker for transmitting information received via said RF module, such information relating to the start and stop of a heating cycle or the adjusted energy level and duration of heat during a heating cycle or temperature and current sensing levels.

28. The induction-heating device as claimed in claim 22, wherein said non-electrically conductive product container comprises an RFID tag for transmitting data correlating to said product in said non-electrically conductive product container to said microprocessor such as cycle time, resonant frequency of electrically conductive metallic target member, product type, and other parameters needed to heat the product according to requirements of the product.

29. The induction-heating device as claimed in claim 28, wherein said electronic circuitry includes an RFID reader communicating said data from said RFID tag to said microprocessor.

30. The induction-heating device as claimed in claim 29, wherein said RFID reader in located in close proximity to said RFID tag.

31. The induction-heating device as claimed in claim 29, further comprising a speaker for transmitting information received via said RFID reader, such information correlating to said product in said non-electrically conductive product container to said microprocessor such as cycle time, resonant frequency of target member, product type, and other parameters needed to heat the product according to requirements of the product.

* * * * *